US011362472B2

(12) United States Patent
DeWitte et al.

(10) Patent No.: US 11,362,472 B2
(45) Date of Patent: Jun. 14, 2022

(54) TERMINAL EXTRACTION TOOL

(71) Applicant: TE CONNECTIVITY CORPORATION, Berwyn, PA (US)

(72) Inventors: Thomas Robert DeWitte, Shelby Township, MI (US); Pushkar S. Kolhatkar, Troy, MI (US)

(73) Assignee: TE Connectivity Corporation, Berwyn, PA (US)

( * ) Notice: Subject to any disclaimer, the term of this patent is extended or adjusted under 35 U.S.C. 154(b) by 8 days.

(21) Appl. No.: 16/822,409

(22) Filed: Mar. 18, 2020

(65) Prior Publication Data

US 2020/0373721 A1 Nov. 26, 2020

Related U.S. Application Data

(60) Provisional application No. 62/850,713, filed on May 21, 2019.

(51) Int. Cl.
*H01R 43/22* (2006.01)

(52) U.S. Cl.
CPC ..... *H01R 43/22* (2013.01)

(58) Field of Classification Search
CPC ..... H01R 43/22; H01R 13/432
See application file for complete search history.

(56) References Cited

U.S. PATENT DOCUMENTS

| | | | | |
|---|---|---|---|---|
| 3,896,535 | A * | 7/1975 | Tucci | H01R 43/22 29/762 |
| 4,083,101 | A * | 4/1978 | Coller | H01R 43/22 29/278 |
| 5,075,960 | A * | 12/1991 | Smith | H01R 43/22 29/739 |
| 2010/0212146 | A1* | 8/2010 | Hamilton | H01R 43/22 29/747 |
| 2013/0042470 | A1* | 2/2013 | Murphy | H01R 43/22 29/764 |
| 2015/0047183 | A1* | 2/2015 | Boyd, Jr. | H01R 43/22 29/764 |

* cited by examiner

*Primary Examiner* — Peter Dungba Vo
*Assistant Examiner* — Jose K Abraham

(57) ABSTRACT

A terminal extraction tool includes a handle and an extraction arm extending from the handle. The handle has a bottom extending between a handle front and a handle rear having a handle axis centered between the handle front and the handle rear. The extraction arm has a base at the bottom of the handle and a finger extending from the base. The finger has an elbow between an upper finger member and a lower finger member. The lower finger member is angled non-parallel to the upper finger member. The lower finger member extends from the elbow to a tip configured to engage a latching beam to release the latching beam and allow removal of the terminal from a housing. The handle and the extraction arm are rotated about the elbow to rotate the lower finger member and the tip to engage the latching beam.

19 Claims, 6 Drawing Sheets

TERMINAL EXTRACTION TOOL

CROSS-REFERENCE TO RELATED APPLICATIONS

This application claims priority to U.S. Provisional Application No. 62/850,713, filed 21 May 2019, which is incorporated by reference herein in its entirety.

BACKGROUND OF THE INVENTION

The subject matter herein relates generally to terminal extraction tools.

Electrical connectors typically include terminals held in a housing. In some known electrical connectors, the terminals are held in the housing using a latch. Extraction tools are known to release latches and allow removal of the terminals. However, access to the latches in some known electrical connectors are restricted. For example, some known terminals include rails above and below the latches to restrict access to the latches, such as to prevent damage to the latches during shipping, handling, assembly, and the like. The rails also restrict access to the latches for the extraction tool. Known extraction tools are unable to release the latches of some known electrical connectors without damaging or destroying parts of the surrounding components, such as the housing or the rails of the terminals. Damage or destruction of the parts leads to requiring full replacement of the electrical connector in service situations.

A need remains for a terminal extraction tool for use in electrical connectors having limited access for terminal release.

BRIEF DESCRIPTION OF THE INVENTION

In one embodiment, a terminal extraction tool is provided including a handle and an extraction arm extending from the handle. The handle has a bottom extending between a handle front and a handle rear having a handle axis centered between the handle front and the handle rear. The extraction arm has a base at the bottom of the handle and a finger extending from the base. The finger has an elbow between an upper finger member and a lower finger member. The lower finger member is angled non-parallel to the upper finger member. The lower finger member extends from the elbow to a tip configured to engage a latching beam to release the latching beam and allow removal of the terminal from a housing. The handle and the extraction arm are rotated about the elbow to rotate the lower finger member and the tip to engage the latching beam.

In an embodiment, a terminal extraction tool is provided including a handle and an extraction arm extending from the handle. The handle includes a bottom extending between a handle front and a handle rear having a handle axis centered between the handle front and the handle rear. The extraction arm has a base at the bottom of the handle and a finger extending from the base to a tip configured to engage a latching beam to release the latching beam and allow removal of the terminal from a housing. The base has a base front and a base rear having a base axis centered between the base front and the base rear. The base is forward offset relative to the handle with the base axis forward of the handle axis. The finger has a finger front and a finger rear having a finger axis centered between the finger front and the finger rear. The finger is forward offset relative to the base with the finger axis forward of the base axis.

In an embodiment, a method of extracting a terminal from a housing is provided including loading a terminal extraction tool into an access opening in the housing. The terminal extraction tool includes a handle and an extraction arm extending from the handle having a base at a bottom of the handle and a finger extending from the base to a tip. The finger has a bend forming an elbow. The terminal extraction tool is loaded into the access opening such that the elbow engages an upper rail of the terminal above a latching beam. The method includes rotating the terminal extraction tool at a pivot point defined by the bend forming the elbow to rotate the tip of the finger under the upper rail to engage the latching beam to release the latching beam. The method includes removing the terminal from the housing.

DETAILED DESCRIPTION OF THE INVENTION

Figure 1:
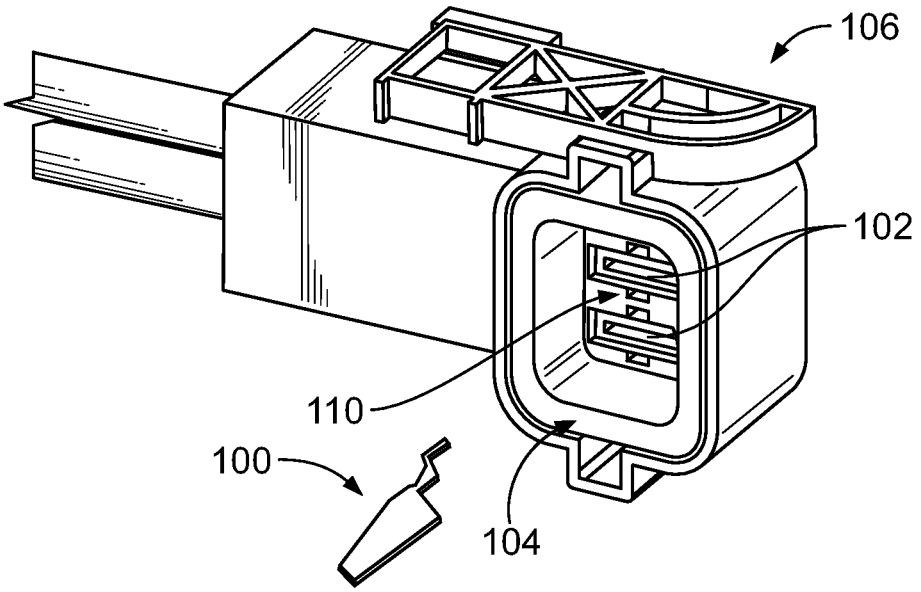
FIG. 1 illustrates a terminal extraction tool in accordance with an exemplary embodiment used to remove terminals from a housing of an electrical connector.

FIG. 1 illustrates a terminal extraction tool 100 in accordance with an exemplary embodiment used to remove terminals 102 from a housing 104 of an electrical connector 106. The terminal extraction tool 100 is configured to be loaded into an access opening 110 in the housing 104 to interface with the terminal 102 and release a latch of the terminal 102 for removal of the terminal 102. In an exemplary embodiment, the terminal extraction tool 100 is shaped to fit in a limited access region of the housing 104 to release the latch of the terminal 102. The terminal extraction tool 100 is configured to be manipulated to release the latch of the terminal 102. For example, the terminal extraction tool 100 may be rotated to a releasing position after being initially loaded into the access opening 110 of the housing 104. The shape of the terminal extraction tool 100 allows the terminal extraction tool 100 to interface with the latch around protective features of the terminal 102 which otherwise limit straight line accessing of the latch.

Figure 2:
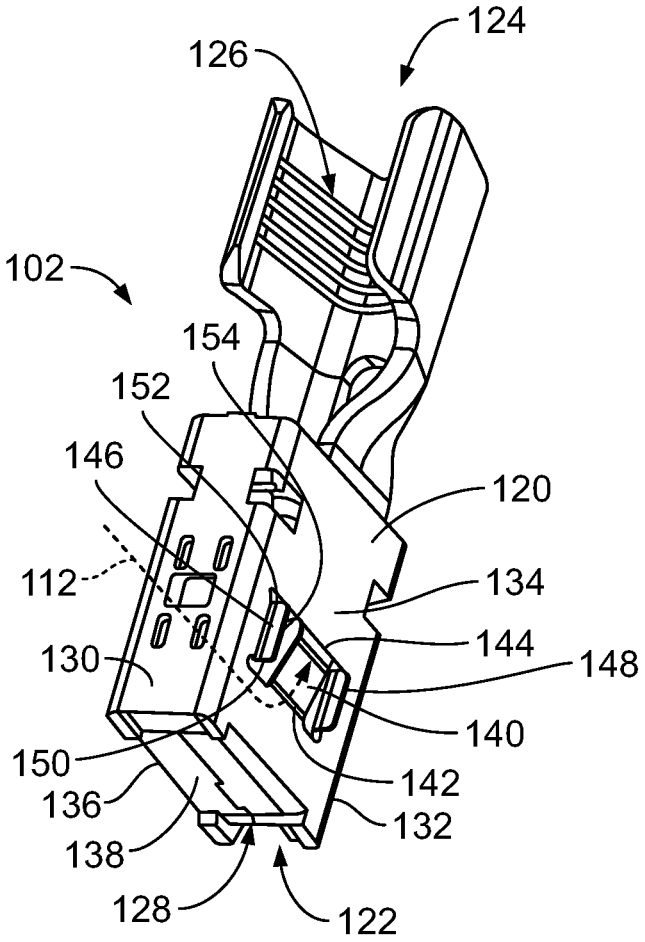
FIG. 2 is a front perspective view of the terminal in accordance with an exemplary embodiment.

FIG. 2 is a front perspective view of the terminal 102 in accordance with an exemplary embodiment. FIG. 2 illustrates an access path 112 for the terminal extraction tool 100

(shown in FIG. 1) to access the latching feature of the terminal 102. The access path 112 follows a nonlinear path to the latching feature.

The terminal 102 includes a terminal body 120 extending between a mating end 122 and a cable end 124. The cable end 124 is configured to be terminated to a power cable. In the illustrated embodiment, the cable end 124 includes a crimp barrel configured to be crimped to the power cable. The cable end 124 may be terminated to the power cable by other means in alternative embodiments. In alternative embodiments, the terminal 102 may be coupled to another component other than a power cable, such as a circuit board.

In an exemplary embodiment, the terminal 102 includes a plurality of walls forming a receptacle 128 configured to receive a mating terminal, such as a blade terminal. In the illustrated embodiment, the terminal body 120 is box shaped forming a rectangular receptacle 128. The receptacle 128 may have other shapes in alternative embodiments. The terminal 102 includes a top 130, a bottom 132, side walls 134, 136 extend between the top 130 and the bottom 132, and an end wall 138 extending between the side walls 134, 136. The end wall 138 is provided at a front of the terminal 102. In the illustrated embodiment, the receptacle 128 is open at the bottom 132 to receive the mating terminal. The terminal 102 is a right-angle terminal configured to receive the mating terminal in a direction perpendicular to the power cable extending from the terminal 102. In alternative embodiments, the end wall 138 may be open to receive the mating terminal. The terminal 102 may have other orientations in alternative embodiments.

The terminal 102 is secured in the housing 104 (shown in FIG. 1) by releasable latching beams 140. In an exemplary embodiment, the latching beam 140 is part of the terminal 102, such as being integral with the terminal 102 (for example, stamped and formed from the terminal 102). For example, the latching beams 140 extend from the side walls 134, 136. In an exemplary embodiment, the latching beams 140 are stamped and formed from the side walls 134, 136. In alternative embodiments, the latching beams 140 may be part of the housing 104. For example, the latching beams 140 may extend from the housing 104 into openings in the side walls 134, 136 to secure the terminal 102 in the housing 104.

The latching beams 140 are used to secure the terminal 102 in the housing 104 (shown in FIG. 1). The latching beams 140 are deflectable, such as deflectable inward to release the latching beams 140 from the housing 104. In an exemplary embodiment, each latching beam 140 includes a fixed end 142 at a front of the latching beam 140 and a free end 144 at a rear of the latching beam 140. The latching beam 140 is angled outward relative to the side wall 134, 136 from the fixed end 142 to the free end 144. The rear edge of the latching beam 140 at the free end 144 is configured to be latchably coupled to the housing 104 to secure the terminal 102 in the housing 104.

In an exemplary embodiment, the terminal 102 includes protecting features for protecting the latching beam 140. In the illustrated embodiment, the protecting features include an upper rail 146 and a lower rail 148. The upper rail 146 is located above the latching beam 140. The lower rail 148 is located below the latching beam 140. The rails 146, 148 extend outward from the side walls 134, 136. For example, the rails 146, 148 may be stamped and formed from the side walls 134, 136. The rails 146, 148 may be bent generally perpendicular to the side walls 134, 136. The upper rail 146 includes a front edge 150, a rear edge 152, and an outer edge 154 extending between the front edge 150 and the rear edge 152. The front edge 150 may be generally aligned with the fixed end 142 of the latching beam 140. The rear edge 152 may be generally aligned with the free end 144 of the latching beam 140. In an exemplary embodiment, the rails 146, 148 have a width wider than the deflection distance of the latching beam 140. As such, the outer edge 154 is located outward of the free end 144 of the latching beam 140 relative to the side wall 134, 136. The rails 146, 148 prevent snagging or catching of the latching beam 140 on other components. For example, the rails 146, 148 prevent wires from catching behind the latching beam 140, which could pull, bend or break the latching beam 140. The rails 146, 148 may prevent other components from catching on the latching beam 140 to damage the latching beam 140.

The rails 146, 148 are aligned with the latching beam 140 (for example, aligned above and below the latching beam 140). As such, the latching beam 140 is inaccessible from above by the upper rail 146 and inaccessible from below by the lower rail 148. Terminal extraction tools are unable to release the latching beam 140 from above or below the latching beam 140. In an exemplary embodiment, the terminal extraction tool 100 follows the access path 112 that is offset relative to the latching beam 140 forward of the rails 146, 148. The terminal extraction tool 100 is configured to be loaded to a depth aligned with the latching beam 140 and then rotated or slid axially inward to engage and release the latching beam 140.

Figure 3:
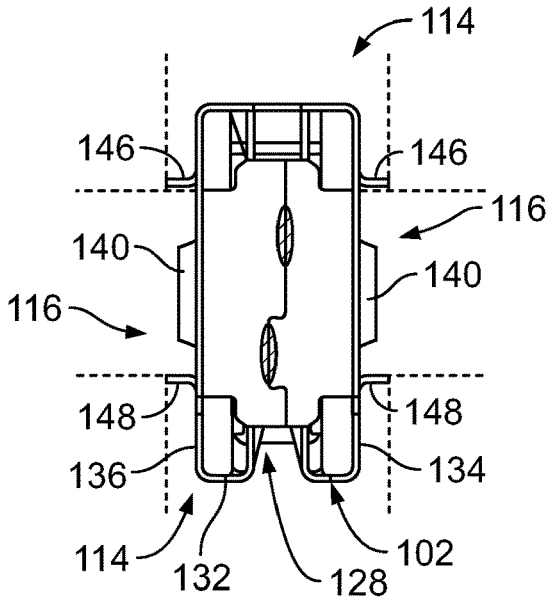
FIG. 3 is a front view of the terminal in accordance with an exemplary embodiment.
Figure 4:
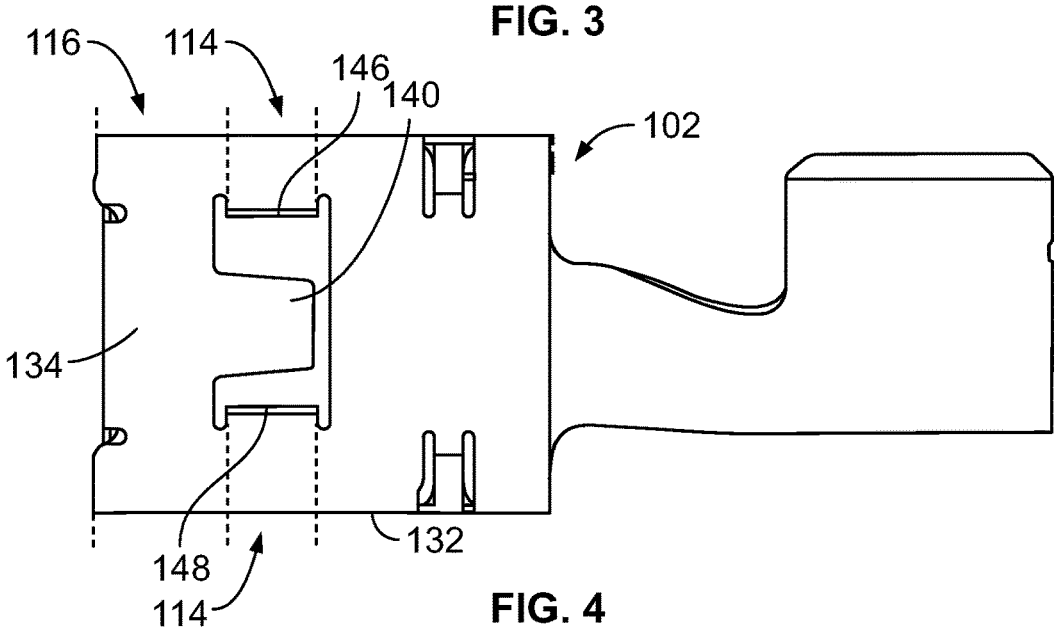
FIG. 4 is a side view of the terminal in accordance with an exemplary embodiment.
Figure 5:
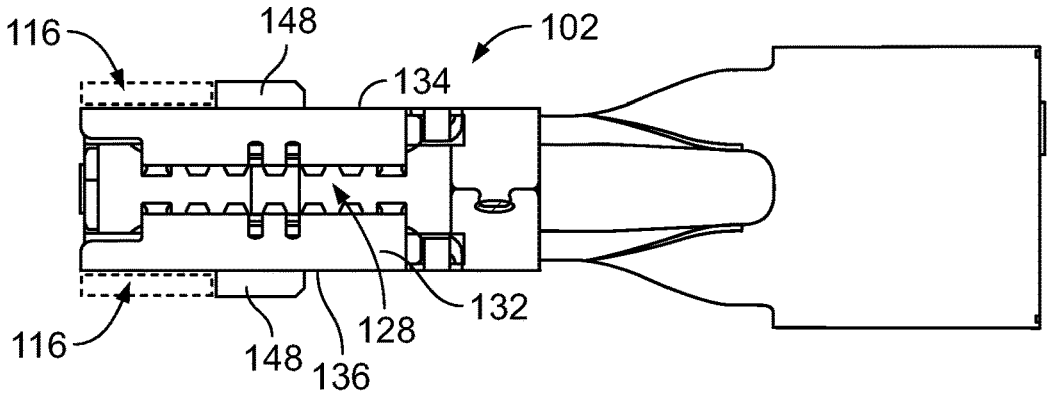
FIG. 5 is an end view of the terminal in accordance with an exemplary embodiment.

FIG. 3 is a front view of the terminal 102 in accordance with an exemplary embodiment. FIG. 4 is a side view of the terminal 102 in accordance with an exemplary embodiment. FIG. 5 is an end view of the terminal 102 in accordance with an exemplary embodiment showing the bottom 132 of the terminal 102 and the receptacle 128 configured to receive the mating terminal. FIGS. 3-5 illustrate restricted zones 114 that restrict access to the latching beam 140 and access zones 116 that allow access to the latching beam 140.

The rails 146, 148 block access to the latching beam 140 and thus define the restricted zones 114. For example, the latching beam 140 is inaccessible from above by the upper rail 146 and is inaccessible from below by the lower rail 148 by the terminal extraction tool 100. However, forward of the rails 146, 148, the side walls 134, 136 are open and accessible for the terminal extraction tool 100. In various embodiments, the latching beam 140 may be accessible from an area outward of the latching beam 140 (for example, outward of the outer edge 154 of the rail 146. However, in various embodiments, the housing 104 (shown in FIG. 1) may restrict access from such area.

Figure 6:
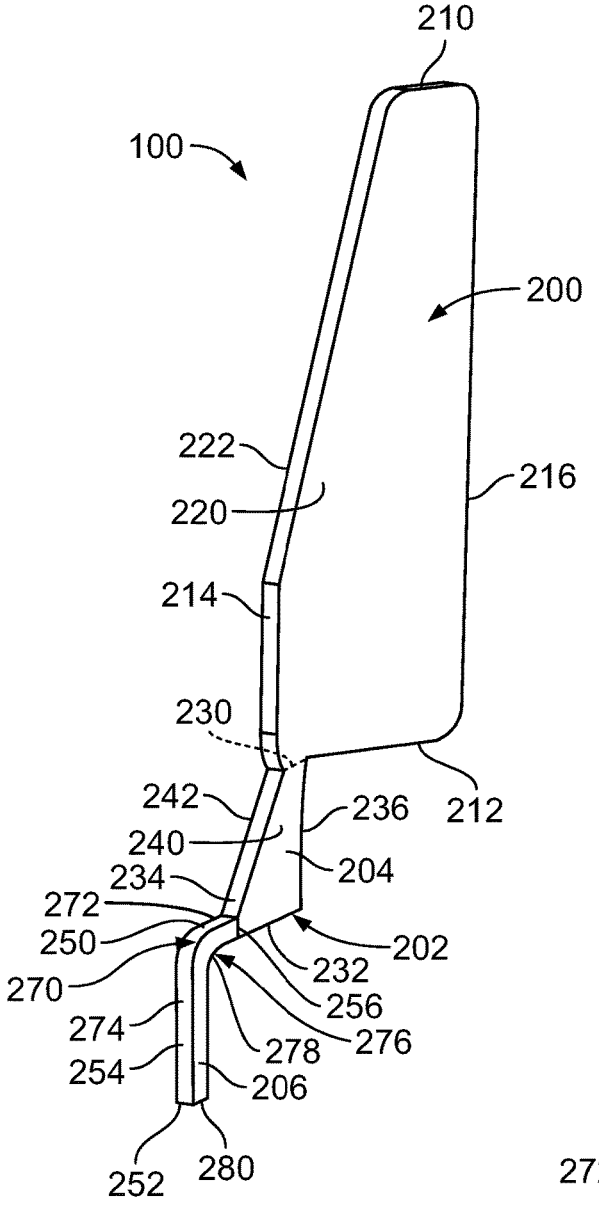
FIG. 6 is a front perspective view of the terminal extraction tool in accordance with an exemplary embodiment.
Figure 7:
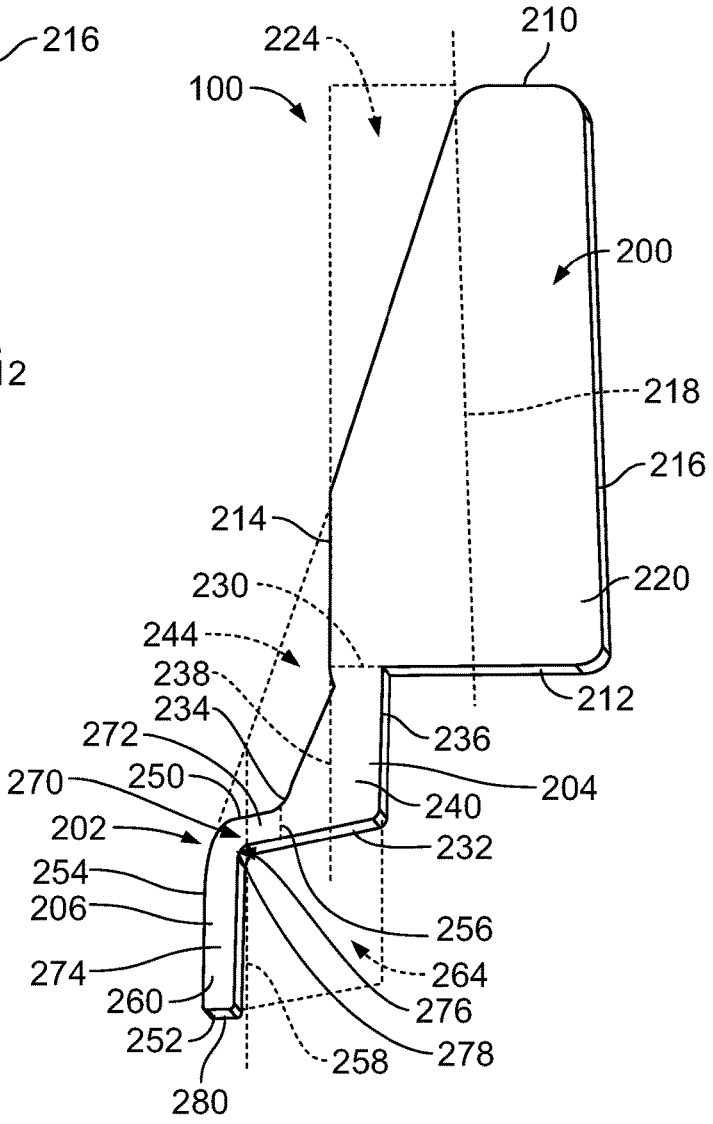
FIG. 7 is a side view of the terminal extraction tool in accordance with an exemplary embodiment.

FIG. 6 is a front perspective view of the terminal extraction tool 100 in accordance with an exemplary embodiment. FIG. 7 is a side view of the terminal extraction tool 100 in accordance with an exemplary embodiment. The terminal extraction tool 100 includes a handle 200 at a top of the terminal extraction tool 100 and an extraction arm 202 extending from the handle 200 at a bottom of the terminal extraction tool 100. The extraction arm 202 includes a base 204 extending from the handle 200 and a finger 206 extending from the base 204. The extraction arm 202 is offset relative to the handle 200. For example, central axes of the extraction arm 202 and the handle 200 may be offset. The extraction arm 202 may be offset in a forward direction in various embodiments, however the extraction arm 202 may be offset in other directions in alternative embodiments. In an exemplary embodiment, the finger 206 is offset relative to the base 204, such as in a forward direction. The finger 206 may be offset in other directions in alternative embodiments, such as being offset out of plane relative to the base 204. In various embodiments, the finger 206 may be offset from the base 204 but aligned with the handle 200. The finger 206 may extend from the base 204 in a straight direction in various embodiments. Alternatively, the finger 206 may extend in multiple directions and/or may be curved. In an exemplary embodiment, the extraction arm 202 is hook shaped to allow the finger 206 to bypass and wrap around and under the upper rail 146 (shown in FIG. 2) of the terminal 102 (shown in FIG. 2) to release the latching beam 140 (shown in FIG. 2).

The handle 200 extends between a handle top 210 and a handle bottom 212. The handle 200 includes a handle front 214 and a handle rear 216. The handle 200 extends along a vertical handle axis 218. The handle axis 218 is centered between the handle front 214 and the handle rear 216. Optionally, at least a portion of the handle front 214 and/or the handle rear 216 may extend parallel to the handle axis 218. In an exemplary embodiment, the handle bottom 212 is downward facing. For example, the handle bottom 212 may be oriented perpendicular to the handle axis 218, such as horizontal, and face in a downward direction. In various embodiments, the handle top 210 may be oriented generally perpendicular to the handle axis 218, such as generally horizontal, and face in an upward direction. In various embodiments, the handle 200 may have a variable width between the handle front 214 and the handle rear 216. For example, the handle 200 may be narrower at the handle top 210 and wider at the handle bottom 212. In an exemplary embodiment, the edge of the handle 200 at the handle front 214 is angled nonparallel to the handle axis 218 to form a handle pocket 224. The handle pocket 224 is devoid of material. For example, the handle pocket 224 may be formed by removing (for example, stamping, cutting) a portion of the handle 200. The handle pocket 224 reduces the weight of the handle 200. Handle pocket 224 reduces the width of the handle, such as at the handle top 210 to allow rotation of the terminal extraction tool 100 in a forward releasing direction without interfering with the housing 104 as the terminal extraction tool 100 is rotated in the releasing direction.

In various embodiments, the handle 200 may include a finger grip, such as a ring, a pocket, or other feature configured to receive a finger of a user for moving the handle 200. In various embodiments, the handle 200 may be sized and shaped to allow the user to grip the opposite first and second sides 220, 222 and pinch the handle 200 between the user's index finger and thumb to manipulate the handle 200. In other various embodiments, the handle 200 may be coupled to a shaft or other device for manipulating the terminal extraction tool 100. Optionally, the terminal extraction tool 100 may include multiple handles 200 coupled together, such as for simultaneously releasing latches of multiple terminals. The handles 200 may be connected to each other at the handle top 210, the handle bottom 212, the handle front 214, the handle rear 216, and/or the sides 220, 222.

In an exemplary embodiment, the extraction arm 202 extends from the handle bottom 212 in a generally downward direction. In an exemplary embodiment, the extraction arm 202 is offset relative to the handle axis 218, such as forward of the handle axis 218. In various embodiments, the entire extraction arm 202 is located forward of the handle axis 218. For example, the extraction arm 202 may extend from the handle bottom 212 generally at the handle front 214. However, the extraction arm 202 may be provided at other locations in alternative embodiments. For example, the extraction arm 202 may extend from the handle front 214 in a generally forward direction, prior to bending in a downward direction. The extraction arm 202 may be offset in other directions in alternative embodiments, such as being offset out of plane relative to the handle 200.

The base 204 extends between a base top 230 and a base bottom 232. The base 204 includes a base front 234 and a base rear 236. The base 204 extends along a vertical base axis 238. The base axis 238 is centered between the base front 234 and the base rear 236. Optionally, at least a portion of the base front 234 and/or the base rear 236 may extend parallel to the base axis 238. Optionally, at least a portion of the base front 234 and/or the base rear 236 may be nonparallel to the base axis 238. In an exemplary embodiment, the base 204 includes first and second sides 240, 242. In various embodiments, the base 204 has the same thickness as the handle 200 such that the first side 240 of the base 204 is co-planer with the first side 220 of the handle 200 and such that the second side 242 of the base 204 is co-planer with the second side 222 of the handle 200.

In an exemplary embodiment, the base bottom 232 is downward facing. For example, the base bottom 232 may be oriented generally perpendicular to the base axis 238, such as generally horizontal, and face in a downward direction. The base top 230 extends from the handle 200, such as from the handle bottom 212. In an exemplary embodiment, the base 204 is integral with the handle 200. For example, the handle 200 and the base 204 may be a monolithic, unitary structure. The base 204 may be stamped and formed with the handle 200. In various embodiments, the base 204 may have a variable width between the base front 234 and the base rear 236. For example, the base 204 may be narrower at the base top 230 and wider at the base bottom 232.

In an exemplary embodiment, the finger 206 extends from the base bottom 232 in a generally downward direction. In an exemplary embodiment, the finger 206 may initially extend forward from the base front 234 and then turn downward. However, the finger 206 may be provided at other locations in alternative embodiments. For example, the finger 206 may extend from the base bottom 232.

In an exemplary embodiment, the finger 206 is integral with the base 204 and the handle 200. For example, the handle 200, the base 204 and the finger 206 may be a monolithic, unitary structure. In alternative embodiments, the handle 200 and/or the base 204 and/or the finger 206 may be separate structures or pieces coupled together. In such embodiments, the handle 200 and/or the base 204 and/or the finger 206 may be manufactured from different materials. The finger 206 may be stamped and formed with the base 204 and the handle 200. The finger 206 extends between a finger top 250 and a finger bottom 252. The finger 206 includes a finger front 254 and a finger rear 256. The finger 206 extends along a vertical finger axis 258. The finger axis 258 is centered between the finger front 254 and the finger rear 256. Optionally, at least a portion of the finger front 254 and/or the finger rear 256 may extend parallel to the finger axis 258. In an exemplary embodiment, the finger 206 is offset forward of the base 204 and the handle 200. For example, the finger axis 258 is located forward of the base axis 238 and forward of the handle axis 218. In an exemplary embodiment, the entire finger 206 is located forward of the base axis 238 and forward of the handle axis 218.

In an exemplary embodiment, the finger 206 includes first and second sides 260, 262. In various embodiments, the finger 206 has the same thickness as the base 204 such that the first side 260 of the finger 206 is co-planer with the first side 240 of the base 204 and such that the second side 262 of the finger 206 is co-planer with the second side 242 of the base 204. In various embodiments, the finger 206 may have a variable width between the finger front 254 and the finger rear 256. For example, the finger 206 may be narrower at the finger top 250 and wider at the finger bottom 252. In various embodiments, the finger 206 may be chamfered or rounded, such as at the finger front 254, the finger rear 256, the sides 260, 262, and the like.

In an exemplary embodiment, the finger 206 includes an elbow 270 between an upper finger member 272 and a lower finger member 274. The upper finger member 272 extends between the elbow 270 and the base 204. The lower finger member 272 extends between the elbow 270 and a tip 280 of the finger 206. The tip 280 is provided at the finger bottom 252. The tip 280 may be provided at the distal end of the terminal extraction tool 100. The tip 280 is used to release the latching beam 140. For example, as the handle 200 and the extraction arm 202 are rotated to the releasing position, the tip 280 is moved into engagement with the latching beam 140 to release the latching beam 140. The tip 280 may be chamfered or rounded for engaging and releasing the latching beam 140. The handle 200 and the extraction arm 202 may be slid axially rearward rather than being rotated to engage and release the latching beam 140 in alternative embodiments. For example, the terminal extraction tool 100 may be moved in a direction non-parallel to the loading direction to move the tip 280 under the upper rail to engage the latching beam 140 to release the latching beam 140.

The elbow 270 includes a bend 276 such that the lower finger member 274 is angled relative to the upper finger member 272. The lower finger member 274 is nonparallel to the upper finger member 272. In various embodiments, the upper finger member 272 may extend generally horizontally and the lower finger member 274 may extend generally vertically. For example, the lower finger member 274 may extend generally parallel to the finger axis 258. In various embodiments, the bend 276 may have a bend angle of approximately 90°. In various embodiments, the bend angle may be between 75° and 105°. The bend angle may be any non-parallel angle (for example, a non-zero or non-180° angle. The finger 206 may be generally hook-shaped or L-shaped. In an exemplary embodiment, an interior surface of the bend 276 forms a pivot point for the terminal extraction tool 100. For example, the terminal extraction tool 100 may be rotated about the pivot point defined at the seat of the bend 276.

In an exemplary embodiment, the terminal extraction tool 100 includes a base pocket 244 and a finger pocket 264. The base pocket 244 is located immediately adjacent the base 204. For example, the base pocket 244 is located forward of the base 204. The base pocket 244 may extend forward of the handle 200. In an exemplary embodiment, the base pocket 244 is located above the finger 206. The base pocket 244 may be formed by the stamping process to remove material to form the shape of the terminal extraction tool 100, such as the base front 234. The material removal reduces the weight of the terminal extraction tool 100. The base pocket 244 forms a negative space within the terminal extraction tool 100 to allow rotation of the terminal extraction tool 100 in a forward releasing direction without interfering with the housing 104 as the terminal extraction tool 100 is rotated in the releasing direction.

The finger pocket 264 is located immediately adjacent the finger 206. For example, the finger pocket 264 is located rearward of the finger 206. The finger pocket 264 may be located below the base 204. The finger pocket 264 may be formed by the stamping process to remove material to form the shape of the terminal extraction tool 100, such as the finger rear 256, and may be used to form the base bottom 232. The finger pocket 264 forms a negative space within the terminal extraction tool 100 to allow rotation of the terminal extraction tool 100 and allow the tip 280 and the lower finger member 274 to be rotated under the upper rail 146 to engage the latching beam 140.

Figure 8:
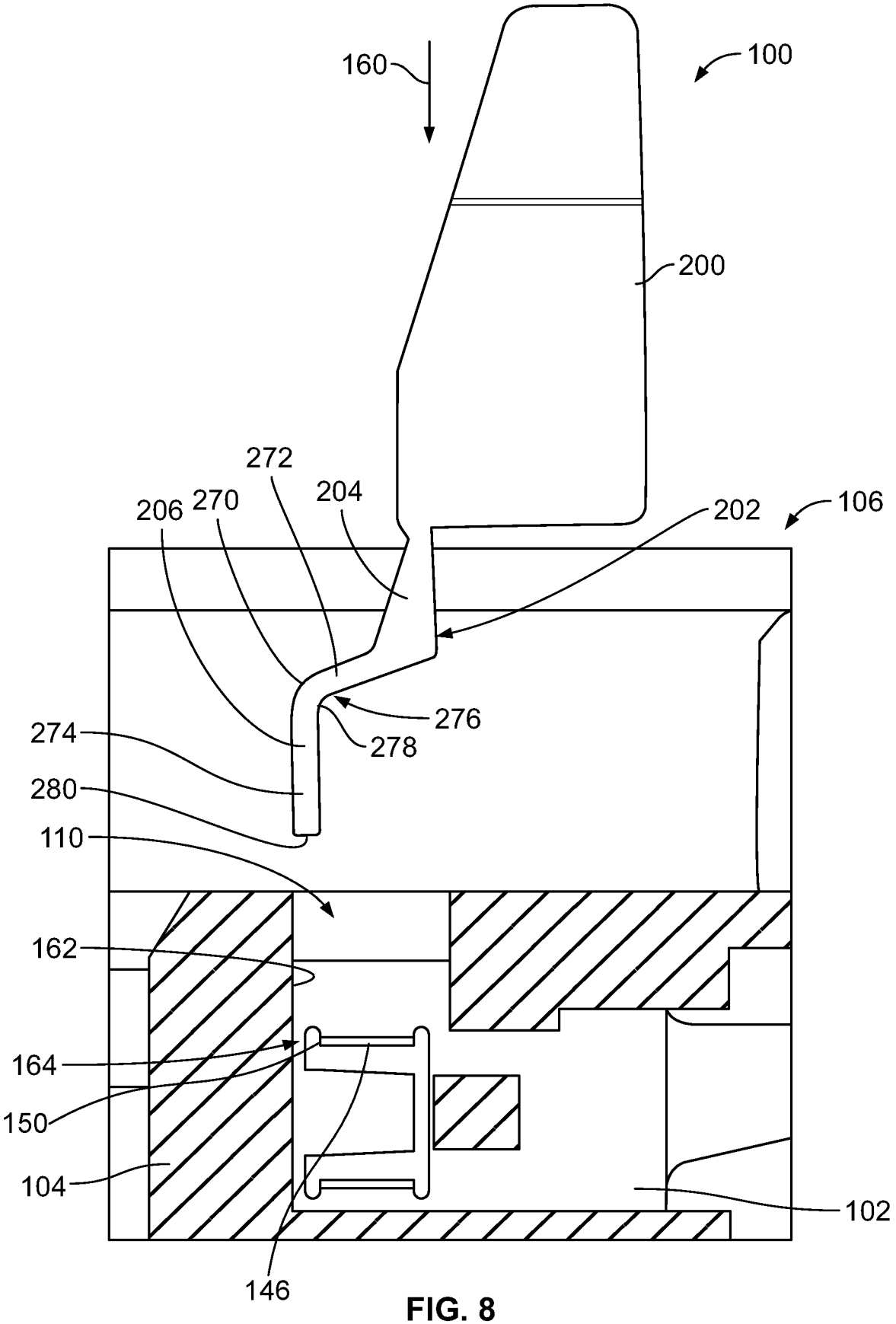
FIG. 8 is a side, partial sectional view of an electrical connector showing the terminal extraction tool poised for loading into the housing of the electrical connector relative to the terminal.
Figure 9:
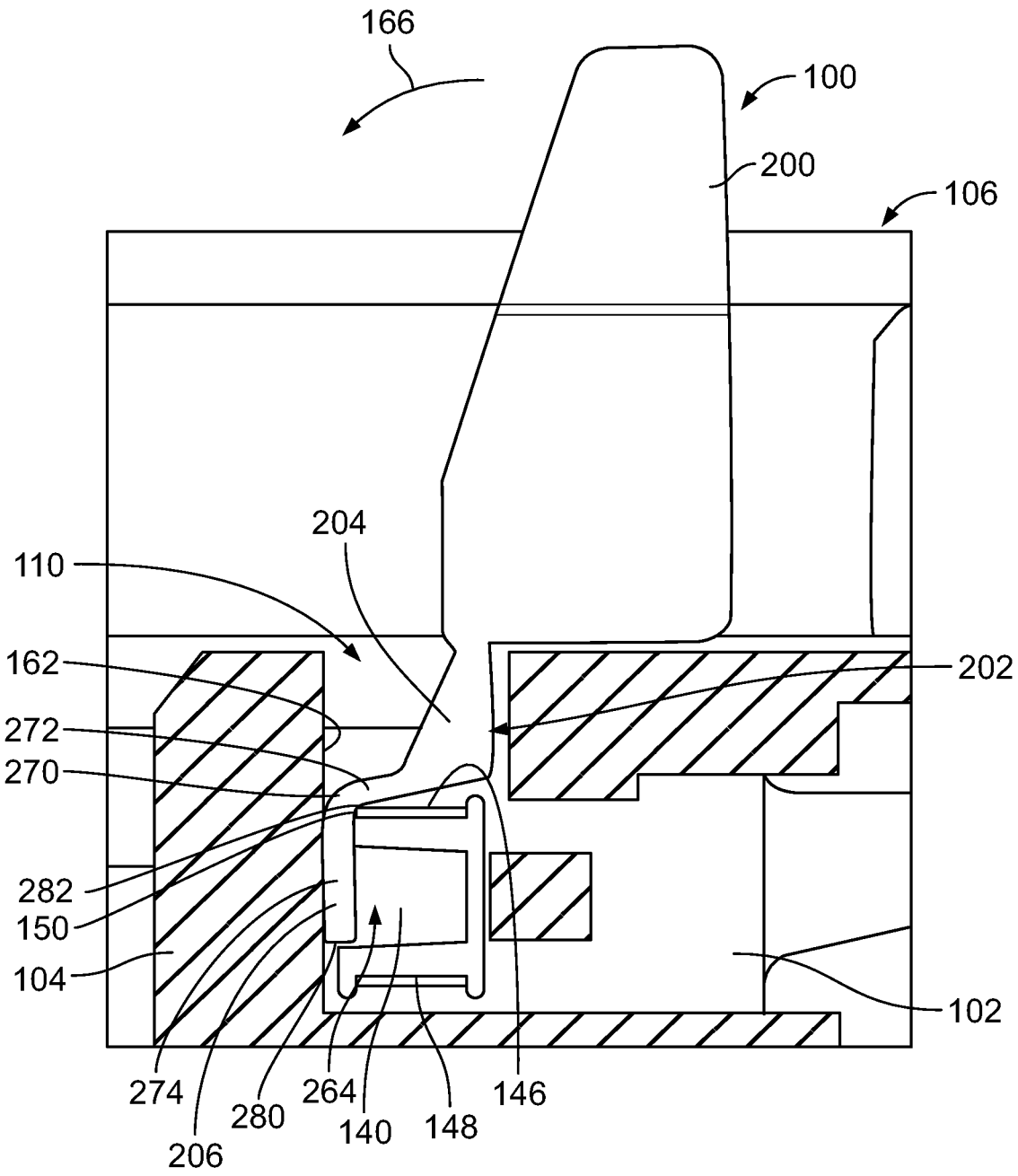
FIG. 9 is a side, partial sectional view of the electrical connector showing the terminal extraction tool loaded into the housing and positioned relative to the terminal.
Figure 10:
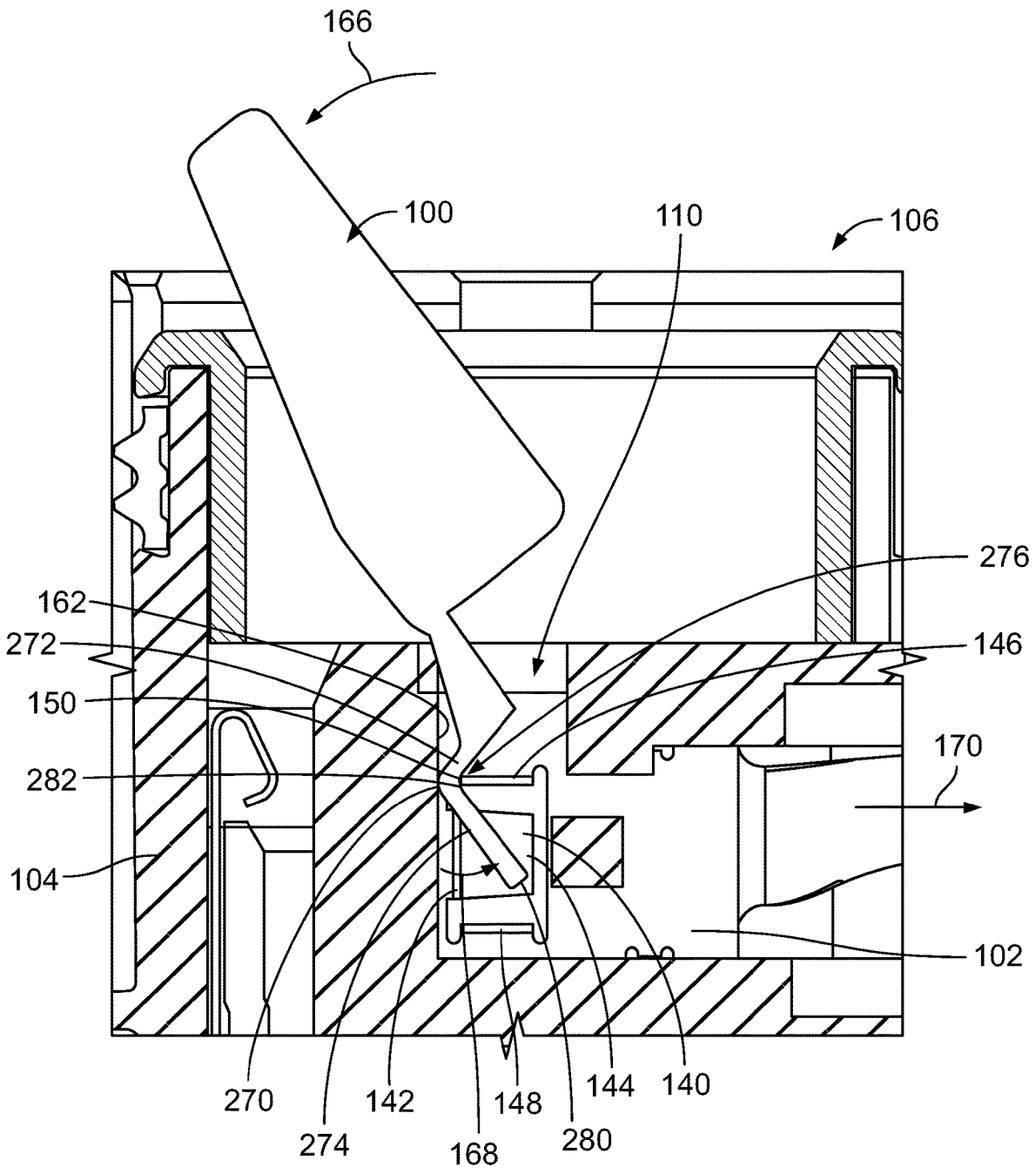
FIG. 10 is a side, partial sectional view of the electrical connector showing the terminal extraction tool in the releasing position for releasing a latching beam of the terminal.

FIG. 8 is a side, partial sectional view of the electrical connector 106 showing the terminal extraction tool 100 poised for loading into the housing 104 relative to the terminal 102. FIG. 9 is a side, partial sectional view of the electrical connector 106 showing the terminal extraction tool 100 fully loaded into the access opening 110 of the housing 104 and positioned relative to the terminal 102 prior to being rotated to the releasing position. FIG. 10 is a side, partial sectional view of the electrical connector 106 showing the terminal extraction tool 100 in the releasing position for releasing the latching beam 140 of the terminal 102.

During use of the terminal extraction tool 100 to release the terminal 102 from the housing 104, the terminal extraction tool 100 is loaded into the access opening 110 of the housing 104 (FIG. 8). The extraction arm 202 of the terminal extraction tool 100 is aligned with the access opening 110. The extraction arm 202 is loaded into the access opening 110 from above. The terminal extraction tool 100 is loaded into the housing 104 in a loading direction 160. The extraction arm 202 is offset with respect to the handle 200 to position the tip 280 of the finger 206 forward of the front edge 150 of the upper rail 146. For example, the finger 206 is jogged forward relative to the base 204 and the handle 200. As such, the tip 280 and the lower finger member 274 are allowed to bypass the upper rail 146, such as between the upper rail 146 and a housing wall 162 of the housing 104 to the fully loaded position (FIG. 9). The lower finger member 274 is loaded into a gap 164 formed between the housing wall 162 and the front edge 150 of the upper rail 146.

In the loaded position (FIG. 9), the terminal extraction tool 100 is loaded into the access opening 110 such that the elbow 270 engages the upper rail 146 of the terminal 102 above the latching beam 140 of the terminal 102. The elbow 270 is seated on the upper rail 146, such as at the front edge 150 of the upper rail 146. The finger 206 is bent around the upper rail 146 between the tip 280 and the base 204. The upper rail 146 and the latching beam 140 are located in the finger pocket 264. In the loaded position, the upper finger member 272 is located above the upper rail 146. The base 204 is located above the upper rail 146. In an exemplary embodiment, in the loaded position, the finger 206 does not engage the latching beam 140. Rather, the lower finger member 274 is positioned forward of the fixed end 142 of the latching beam 140. The lower finger member 274 extends along the housing wall 162 to align the tip 280 with the latching beam 140.

During use of the terminal extraction tool 100, the terminal extraction tool 100 is rotated forward. The user pushes or pulls the handle 200 and an actuation direction 166 for example, the handle 200 and the extraction arm 202 are pivoted about a pivot point 282 defined by the interior surface 278 of the bend 276. The terminal extraction tool 100 is pivoted about the upper rail 146, such as at the front edge 150 of the upper rail 146. The upper rail 146 defines a pivot point for the terminal extraction tool 100. The terminal extraction tool 100 may pivot about another structure in alternative embodiments. As the handle 200 and the base 204 are pivoted forward, the lower finger member 274 and the tip 280 are pivoted rearward to engage the latching beam 140. The lower finger member 274 and the tip 280 are rotated in a releasing direction 168 to the releasing position (FIG. 10). In the releasing position, the tip 280 is located below the upper rail 146 in contact with the latching beam 140. The tip releases the latching beam 140 by pressing inward on the side of the latching beam 140, such as near the free end 144 of the latching beam 140. As the terminal extraction tool 100 is rotated in the releasing direction 168, the tip 280 of the finger 206 slides along the side of the terminal 102 in an arcuate path to release the latching beam 140. After the latching beam 140 is released, the terminal 102 may be removed by removing the terminal 102 in a terminal removal direction 170. The terminal removal direction 170 is perpendicular to the terminal extraction tool loading direction 160.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A terminal extraction tool comprising:

a handle having a bottom extending between a handle front and a handle rear, the handle having a handle axis centered between the handle front and the handle rear, the handle being planar and including a handle side defining a handle plane; and an extraction arm extending from the handle, the extraction arm having a base extending from the bottom of the handle and a finger extending from the base, the finger having an elbow between an upper finger member and a lower finger member, the elbow having a pivot point, the lower finger member being angled non-parallel to the upper finger member, the lower finger member extending from the elbow to a tip, the tip being configured to engage a latching beam to release the latching beam and allow removal of a terminal from a housing, the extraction arm being planar and including an extraction arm side defining an extraction arm plane, the extraction arm plane being coplanar with the handle plane;

wherein the handle and the extraction arm are rotated about the pivot point of the elbow to rotate the lower finger member and the tip to engage the latching beam.

2. The terminal extraction tool of claim 1, wherein the elbow includes a bend, an interior surface of the finger at the bend of the elbow defining the pivot point for rotating the handle and the extraction arm.

3. The terminal extraction tool of claim 1, wherein the finger includes at least one bend.

4. The terminal extraction tool of claim 1, wherein the upper finger member is oriented relative to the lower finger member at an angle between 75° and 105°.

5. The terminal extraction tool of claim 1, wherein the upper finger member extends from a bottom of the base at a base front of the base, the lower finger member being located below the base.

6. The terminal extraction tool of claim 1, wherein the entire extraction arm is located forward of the handle axis.

7. The terminal extraction tool of claim 1, wherein the entire finger is located forward of the handle.

8. The terminal extraction tool of claim 1, wherein the base has a variable width between a base front and a base rear, the base being wider at a base bottom and being narrower at a base top.

9. The terminal extraction tool of claim 1, wherein the upper finger member extends along a first linear axis between the elbow and the tip and wherein the lower finger member extends along a second linear axis between the elbow and the base, the second linear axis being angled transverse to the first linear axis.

10. The terminal extraction tool of claim 1, wherein the lower finger member is adapted to access an access opening of a housing holding the terminal at a position forward of the latching beam and forward of an upper rail above the latching beam, the upper finger member and a bottom of the base of the extraction arm adapted to access the upper rail above the upper rail, the tip of the lower finger member configured to be rotated under the upper rail to engage and release the latching beam.

11. The terminal extraction tool of claim 1, wherein a pocket is defined between the finger and the handle configured to receive a housing holding the terminal when the handle and the extraction arm are rotated to a releasing position.

12. A terminal extraction tool comprising:

a handle having a bottom extending between a handle front and a handle rear, the handle having a handle axis centered between the handle front and the handle rear, the handle including a handle side defining a handle plane; and an extraction arm extending from the handle, the extraction arm including an extraction arm side defining an extraction arm plane, the extraction arm plane being coplanar with the handle plane, the extraction arm having a base extending from the bottom of the handle and a finger extending from the base to a tip, the tip configured to engage a latching beam to release the latching beam and allow removal of a terminal from a housing, the base having a base front and a base rear, the base having a base axis centered between the base front and the base rear, the base being forward offset relative to the handle with the base axis forward of the handle axis, the finger having a finger front and a finger rear, the finger having a finger axis centered between the finger front and the finger rear, the finger being forward offset relative to the base with the finger axis forward of the base axis.

13. The terminal extraction tool of claim 12, wherein the finger includes an elbow between an upper finger member and a lower finger member, the elbow having a pivot point, wherein the handle and the extraction arm are rotated about the pivot point of the elbow to rotate the lower finger member and the tip to engage the latching beam.

14. The terminal extraction tool of claim 12, wherein the finger includes an elbow between an upper finger member and a lower finger member, the elbow including a bend, wherein an interior surface of the finger at the bend of the elbow defines a pivot point for rotating the handle and the extraction arm.

15. The terminal extraction tool of claim 12, wherein the entire extraction arm is located forward of the handle axis.

16. The terminal extraction tool of claim 12, wherein the finger includes an elbow between an upper finger member and a lower finger member, the lower finger member adapted to access an access opening of a housing holding the terminal at a position forward of the latching beam and forward of an upper rail above the latching beam, the upper finger member and a bottom of the base of the extraction arm adapted to access the upper rail above the upper rail, the tip of the lower finger member configured to be rotated under the upper rail to engage and release the latching beam.

17. The terminal extraction tool of claim 1, wherein the handle includes a first handle side and a second handle side opposite the first handle side, and wherein the extraction arm includes a first extraction arm side and a second extraction arm side opposite the first extraction arm side, the first handle side of the handle being coplanar with the first extraction arm side of the extraction arm, the second handle side of the handle being coplanar with the second extraction arm side of the extraction arm.

18. The terminal extraction tool of claim 12, wherein the handle includes a first handle side and a second handle side opposite the first handle side, and wherein the extraction arm includes a first extraction arm side and a second extraction arm side opposite the first extraction arm side, the first handle side of the handle being coplanar with the first extraction arm side of the extraction arm, the second handle side of the handle being coplanar with the second extraction arm side of the extraction arm.

19. A terminal extraction tool comprising:

a handle having a bottom extending between a handle front and a handle rear, the handle having a handle axis centered between the handle front and the handle rear; and an extraction arm extending from the handle, the extraction arm having a base extending from the bottom of the handle and a finger extending from the base, the finger having an elbow between an upper finger member and a lower finger member, the lower finger member being angled non-parallel to the upper finger member, the lower finger member extending from the elbow to a tip, the tip being configured to engage a latching beam to release the latching beam and allow removal of the terminal from a housing;

wherein the handle and the extraction arm are rotated about the elbow to rotate the lower finger member and the tip to engage the latching beam, wherein the base has a variable width between a base front and a base rear, the base being wider at a base bottom and being narrower at a base top.

* * * * *